US005761929A

United States Patent [19]

Freilich

[11] Patent Number: 5,761,929

[45] Date of Patent: Jun. 9, 1998

[54] FACET CUT STRUCTURE FOR COLORED STONES TO ENHANCE BRILLIANCE

[75] Inventor: Joseph Freilich, Old Westbury, N.Y.

[73] Assignee: M. Fabrikant & Sons, Ltd., New York, N.Y.

[21] Appl. No.: 712,812

[22] Filed: Sep. 12, 1996

[51] Int. Cl.[6] ..... A44C 17/00

[52] U.S. Cl. ..... 63/32

[58] Field of Search ..... 63/32, 15, 12, 63/3, 35, 36; D11/88, 90

[56] References Cited

U.S. PATENT DOCUMENTS

| | | | |
|---|---|---|---|
| D. 48,644 | 2/1916 | Miller | D11/90 |
| D. 85,505 | 11/1931 | Zell | D11/90 |
| D. 360,376 | 7/1995 | Kaplan | D11/90 |
| 2,009,390 | 7/1935 | Bayardi | 63/32 |
| 2,364,031 | 11/1944 | Suderov | 63/32 |
| 3,585,764 | 6/1971 | Huisman | 63/32 X |
| 3,796,065 | 3/1974 | Watermeyer | 63/32 |
| 3,835,665 | 9/1974 | Kitchel | 63/32 |
| 4,020,649 | 5/1977 | Grossbard | 63/32 |
| 4,118,950 | 10/1978 | Grossbard | 63/32 |
| 4,555,916 | 12/1985 | Grossbard | 63/32 |

*Primary Examiner*—David M. Purol

*Attorney, Agent, or Firm*—Levisohn, Lerner, Berger & Langsam

[57] ABSTRACT

A new structure for a colored gem, generally round or oval, in which a barrel cut is employed, but which has a center top edge and transverse boundaries which increases the thickness of the stone with additional facets provided to enhance reflection and overall brilliance.

51 Claims, 3 Drawing Sheets

FACET CUT STRUCTURE FOR COLORED STONES TO ENHANCE BRILLIANCE

BACKGROUND OF INVENTION

The present invention is directed to improving the brilliance of diamond and colored precious and semi-precious stones. A new structure is provided which increases enhanced brilliance radiated from the precious stones by increasing reflecting surface area and the thickness of the stone.

Precious and semi-precious stones are cut to provide brilliance in an economical manner. This invention preferably is directed to round or oval stones in which a flat table normally is generally provided for the top surface In some prior art structures, a barrel cut is provided which reduces the size of the flat table, but still has a large flat top area as well as unbroken parallel edges between rows of linear facet cuts extending from end to end of the stone. The present invention's structure provides a similar cut to the barrel cut while eliminating the large flat top area and otherwise providing structural differences which enhance the brilliance of the stone. The present invention not only improves brilliance of stones, but it improves the attractive and creative qualities of precious stone jewelry.

SUMMARY OF INVENTION

An object of this invention is to increase overall brilliance for colored stones.

Another object of this invention is to improve the design quality of precious stone jewelry by replacing the flat horizontal surface of the table of a stone with a new structure.

Still another object of this invention is to provide a new facet cut structure to increase brilliance.

Other objects, advantages, and features of the present invention will become apparent hereinafter.

The new invention improves the enhancement of brilliance of precious stones. The present invention replaces the flat horizontal surface of the table of a stone and increases the use of facet cuts to increase reflecting surface areas and overall thickness of the stone. Reflecting surface areas are responsible for reflecting light rays to radiate brilliance. Replacing the flat horizontal surface for the table enables more light rays to radiate from the top surface of the precious stone.

The structure of the new invention also provides greater brilliance because a thicker precious stone is realized. It is realized by having the upper portion of the stone continually step upwardly until reaching a center top edge. The height of the top of the stone to the girdle and to the culet is materially greater than that of the prior art. Such thickness provides greater color and brilliance of the new stone structure than found in the prior art. Providing a precious stone structure with more brilliance also greatly expands the artistic and attractive values of such precious stone jewelry.

This facet cut colored stone has a conical bottom and an upper surface with the upper surface cut to present a stepped facet cut terminating in a top center edge. In contrast to the prior art where the upper surface terminates in a flat table as seen in FIG. 2, the upper surface herein continuously is stepped upwardly to the top center edge. The thickness of the stone from the annular girdle to the top is increased which provides more color saturation and results in enhanced brilliance for the stone.

The same cut can be used for diamonds, but because of the loss factor, the carat weight loss may be too great to compensate for the increased brilliance of the stone.

DETAILED DESCRIPTION OF THE INVENTION

Figure 1:
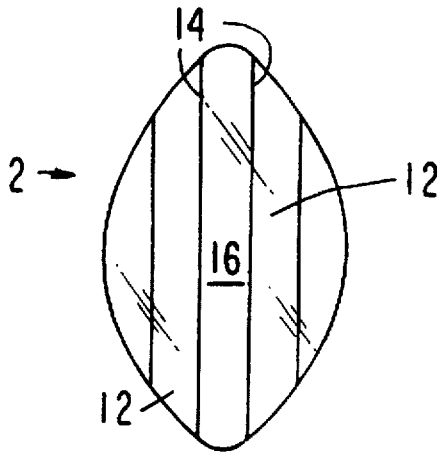
FIG. 1 PRIOR ART
FIG. 1 is a top view of a prior art barrel cut precious stone.
Figure 2:
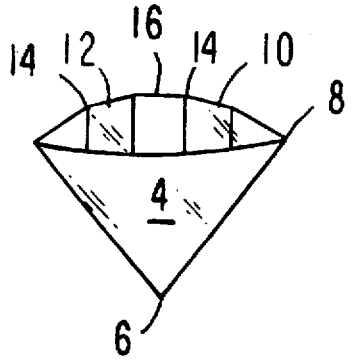
FIG. 2 PRIOR ART
FIG. 2 is a perspective view of the prior art precious stone shown in FIG. 1.
Figure 3:
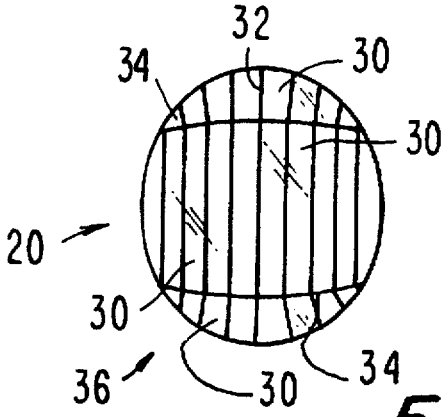
FIG. 3 is a top view of a precious stone with the new structure of the present step invention designed to provide enhanced brilliance.
Figure 4:
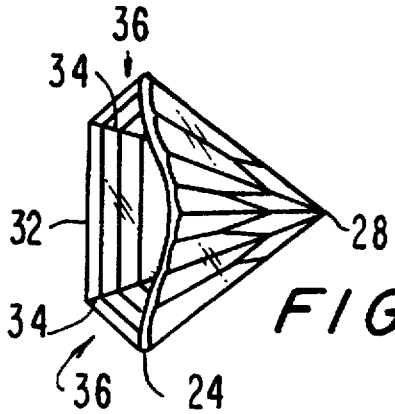
FIG. 4 is a side view of the precious stone shown in FIG. 3.
Figure 5:
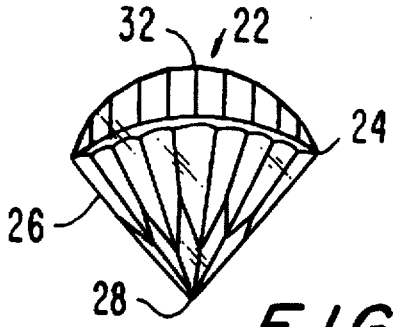
FIG. 5 is a front end view of the precious stone shown in FIGS. 3 and 4.
Figure 6:
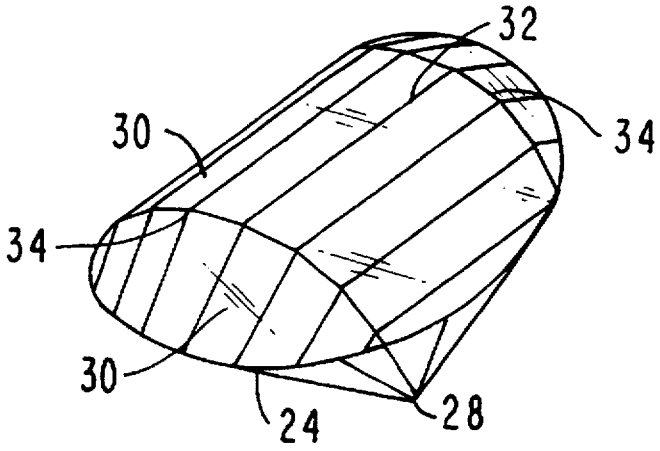
FIG. 6 is a perspective view of the precious stone shown in FIGS. 3, 4, and 5.
Figure 7:
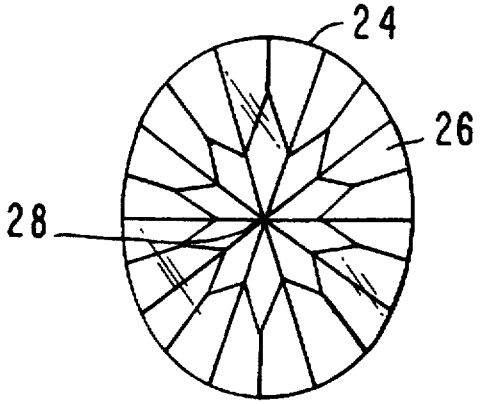
FIG. 7 is a bottom view of the precious stone shown in FIGS. 3, 4, 5, and 6.

FIGS. 1 and 2 show the prior art barrel cut precious stone 2, which contains a conical base 4 with a culet 6 on the bottom. It also contains a girdle 8 separating a rounded upper surface 10, which comprises a plurality of parallel facet cuts 12 separated by parallel edges 14 that run north to south. There is a center flat table 16 on top of the upper surface 10.

FIGS. 3 through 7 show various views of the present invention, which is a new structure for a cut precious stone that enhances overall brilliance. The illustrated stone 20 is oval but could be round or any other suitable shape. The stone 20 contains an upper rounded portion 22 terminating in an annular girdle 24 which separates the upper rounded portion 22 from a lower conical portion 26 which terminates in a lower culet 28.

The upper rounded portion 22 contains an upper approximately rounded convex surface made up of angled facet cuts 30 which produce a stepped buildup from the annular girdle 24 to a top edge 32 of the precious stone. The top edge 32 is aligned with the culet 28 location and is in the approximate center of the stone. This stepped buildup design provides a thicker amount of precious stone material. The amount of precious stone material is related to its ability to enhance brilliance and provide more color saturation. Therefore, more precious stone material enhances brilliance. As part of its design, the present invention, compared with the prior art, provides greater amount of precious stone material from the top edge 32 to the girdle 24 to achieve enhanced brilliance.

The present invention's ratio of precious stone material from the top 32 of the precious stone to its culet 28 surpasses that of the prior art. Consequently, an increase in thickness in precious stone material leads to greater color saturation which in turn enhances brilliance as well.

This invention also utilizes breaks 34 in the facet cuts to radiate more brilliance. Breaks 34 function like facet cuts 30 except that they are located on the sides 36 of the precious stone. As stated previously, when the precious stone reduces the loss of entering light rays, these light rays are then reflected. Breaks 34 provide another outlet for these light rays to exit, which results in enhanced brilliance.

This invention has been described with reference to a preferred embodiment. Other variations may be made which come within the teaching of the present invention as set forth in the appended claims. Such variations can include the shape and/or material for the stones.

I claim:

1. A jewelry stone comprising a culet, and a conical base pavilion with faceted surfaces emanating from said culet, said conical base portion terminating in a regular rounded girdle forming the outer regular rounded surface of said stone, said stone comprising an upper rounded convex surface having first parallel boundaries between adjacent cuts with said boundaries extending from a north side to an opposite south side of said stone, said stone further comprising at least one transverse boundary substantially transverse to said first parallel boundaries, said transverse boundary forming a continuous line from east to west sides of said stone, said transverse boundary being nonparallel to said upper rounded convex surface, said transverse boundary comprising a first side and a second side, said first parallel boundaries intersecting said transverse boundary on said first side of said transverse boundary, said stone further comprising a series of second boundaries on said second side of said transverse boundary, said series of second boundaries forming a series of non-converging lines.

2. The invention as set forth in claim 1 wherein said jewelry stone is oval.

3. The invention as set forth in claim 1 wherein said jewelry stone is round.

4. The invention as set forth in claim 1 wherein said jewelry stone is pear-shaped.

5. The invention as set forth in claim 1 wherein said jewelry stone is a colored stone.

6. The invention as set forth in claim 2 wherein said jewelry stone is a colored stone.

7. The invention as set forth in claim 3 wherein said jewelry stone is a colored stone.

8. The invention as set forth in claim 4 wherein said jewelry stone is a colored stone.

9. The invention as set forth in claim 1, wherein said upper rounded convex surface extends symmetrically outwardly toward said girdle toward said transverse boundaries, further comprising downwardly sloping faceted surfaces symmetrically designed with relationship to the stone and extending from said transverse boundaries to said girdle.

10. The invention as set forth in claim 2, wherein said upper rounded convex surface extends symmetrically outwardly toward said girdle toward said transverse boundaries, further comprising downwardly sloping faceted surfaces symmetrically designed with relationship to the stone and extending from said transverse boundaries to said girdle.

11. The invention as set forth in claim 3, wherein said upper rounded convex surface extends symmetrically outwardly toward said girdle toward said transverse boundaries, further comprising downwardly sloping faceted surfaces symmetrically designed with relationship to the stone and extending from said transverse boundaries to said girdle.

12. The invention as set forth in claim 4, wherein said upper rounded convex surface extends symmetrically outwardly toward said girdle toward said transverse boundaries, further comprising downwardly sloping faceted surfaces symmetrically designed with relationship to the stone and extending from said transverse boundaries to said girdle.

13. The invention as set forth in claim 5, wherein said upper rounded convex surface extends symmetrically outwardly toward said girdle toward said transverse boundaries further comprising downwardly sloping faceted surfaces symmetrically designed with relationship to the stone and extending from said transverse boundaries to said girdle.

14. A jewelry stone as claimed in claim 1, wherein said jewelry stone comprises a region having two approximately convex sides, one of said sides being said transverse boundary, the other of said sides being a portion of said upper rounded convex surface.

15. A jewelry stone as claimed in claim 1, wherein said series of second boundaries are parallel.

16. A jewelry stone as claimed in claim 1, wherein said first parallel boundaries intersect and cross said transverse boundary and continuing on past said transverse boundary to form said series of second boundaries, and wherein said second boundaries form a series of non-converging lines.

17. A jewelry stone as claimed in claim 15, wherein said series of second boundaries are parallel.

18. A jewelry stone as claimed in claim 1, wherein said at least one transverse boundary comprises a plurality of transverse boundaries.

19. A jewelry stone as claimed in claim 1, wherein said at least one transverse boundary comprises a first transverse boundary on an east side of said stone, and a second transverse boundary on a west side of said stone.

20. A jewelry stone as claimed in claim 1, wherein said cullet comprises a single point.

21. A jewelry stone as claimed in claim 1, wherein said upper rounded convex surface comprises a top edge aligned with said culet.

22. A jewelry stone as claimed in claim 1, wherein said upper rounded convex surface terminates in a center top edge aligned with said culet.

23. A jewelry stone as claimed in claim 1, wherein said upper rounded convex surface form a plurality of faceted upwardly stepped segments.

24. A jewelry stone comprising:

an upper rounded surface comprising a north side, a south side, an east side, a west side, and a series of facet cuts, said upper rounded surface further comprising first parallel boundaries between said facet cuts, with said first parallel boundaries extending from said north side to said south side;

said stone comprising at least one transverse boundary substantially transverse to said first parallel boundaries, said transverse boundary forming a line from said east side to said west side of said stone, said transverse boundary comprising a first side and a second side, said first parallel boundaries intersecting said transverse boundary on said first side of said transverse boundary;

said stone further comprising a series of second boundaries on said second side of said transverse boundary, said series of second boundaries forming a series of non-converging lines; and, a culett, said culet comprising a single point.

25. A jewelry stone as claimed in claim 24, wherein said jewelry stone comprises a region having two approximately convex sides, one of said sides being said transverse boundary, the other of said sides being a portion of said upper rounded convex surface.

26. A jewelry stone as claimed in claim 25, wherein said upper rounded surface comprises a top edge aligned with said culet.

27. A jewelry stone as claimed in claim 25, wherein said upper rounded surface terminates in a center top edge aligned with said culet.

28. A jewelry stone as claimed in claim 25, wherein said series of second boundaries are parallel.

29. A jewelry stone as claimed in claim 25, wherein at least a portion of said first parallel boundaries intersect and cross said transverse boundary and continuing on past said transverse boundary to form said series of second boundaries, and wherein said second boundaries form a series of non-converging lines.

30. A jewelry stone as claimed in claim 28, wherein said series of second boundaries are parallel.

31. A jewelry stone as claimed in claim 25, wherein said at least one transverse boundary comprises a plurality of transverse boundaries.

32. A jewelry stone as claimed in claim 25, wherein said at least one transverse boundary comprises a first transverse boundary on an east side of said stone, and a second transverse boundary on a west side of said stone.

33. A jewelry stone as claimed in claim 25, wherein said upper rounded surface form a plurality of faceted upwardly stepped segments.

34. A jewelry stone as claimed in claim 25, wherein said upper rounded surface is oval.

35. A jewelry stone as claimed in claim 25, wherein said upper rounded surface is circular.

36. A jewelry stone as claimed in claim 25, wherein said upper rounded surface is pear shaped.

37. A jewelry stone comprising:

an upper rounded surface comprising a north side, a south side, an east side, a west side, and a series of facet cuts, said upper rounded surface further comprising first parallel boundaries between said facet cuts, with said first parallel boundaries extending from said north side to said south side;

said stone comprising two transverse boundaries substantially transverse to said first parallel boundaries, each of said transverse boundaries forming a line from said east side to said west side of said stone, said transverse boundary comprising a first side and a second side, said first parallel boundaries intersecting said transverse boundary on said first side of said transverse boundary;

said stone further comprising a series of second boundaries on said second side of said transverse boundary, said series of second boundaries forming a series of non-converging lines; and, a culet, said culet comprising a single point.

38. A jewelry stone as claimed in claim 37, wherein said upper rounded convex surface comprises a top edge aligned with said culet.

39. A jewelry stone as claimed in claim 38, wherein said jewelry stone comprises a region having two approximately convex sides, one of said sides being said transverse boundary, the other of said sides being a portion of said upper rounded convex surface.

40. A jewelry stone as claimed in claim 37, wherein said upper rounded convex surface terminates in a center top edge aligned with said culet.

41. A jewelry stone as claimed in claim 39, wherein said series of second boundaries are parallel.

42. A jewelry stone as claimed in claim 39, wherein at least a portion of said first parallel boundaries intersect and cross said transverse boundary and continuing on past said transverse boundary to form said series of second boundaries, and wherein said second boundaries form a series of non-converging lines.

43. A jewelry stone as claimed in claim 39, wherein said series of second boundaries are parallel.

44. A jewelry stone as claimed in claim 39, wherein said at least one transverse boundary comprises a plurality of transverse boundaries.

45. A jewelry stone as claimed in claim 39, wherein said upper rounded convex surface form a plurality of faceted upwardly stepped segments.

46. A jewelry stone as claimed in claim 38, wherein said upper rounded surface is oval.

47. A jewelry stone as claimed in claim 38, wherein said upper rounded surface is circular.

48. A jewelry stone as claimed in claim 38, wherein said upper rounded surface is pear shaped.

49. A jewelry stone as claimed in claim 14, further comprising a three sided section at the top of said region.

50. A jewelry stone as claimed in claim 25, further comprising a three sided section at the top of said region.

51. A jewelry stone as claimed in claim 39, further comprising a three sided section at the top of said region.

* * * * *